US009709234B2

(12) United States Patent
Wang

(10) Patent No.: US 9,709,234 B2
(45) Date of Patent: Jul. 18, 2017

(54) VEHICLE LAMP STRUCTURE

(71) Applicant: ADI OPTICS CO., LTD., New Taipei (TW)

(72) Inventor: Cheng Wang, Taipei (TW)

(73) Assignee: Cheng Wang, Taipei (TW)

( * ) Notice: Subject to any disclaimer, the term of this patent is extended or adjusted under 35 U.S.C. 154(b) by 100 days.

(21) Appl. No.: 14/629,601

(22) Filed: Feb. 24, 2015

(65) Prior Publication Data

US 2015/0241012 A1 Aug. 27, 2015

(30) Foreign Application Priority Data

Feb. 24, 2014 (TW) ..... 103106033 A

(51) Int. Cl.
*F21V 7/00* (2006.01)
*F21S 8/10* (2006.01)

(52) U.S. Cl.
CPC ..... *F21S 48/1159* (2013.01); *F21S 48/1352* (2013.01); *F21S 48/1747* (2013.01)

(58) Field of Classification Search
CPC ..... F21S 48/1159; F21S 48/1163; F21S 48/1352; F21S 48/1358; F21S 48/1747; F21S 48/1752
USPC ..... 362/517
See application file for complete search history.

(56) References Cited

U.S. PATENT DOCUMENTS

2006/0120094 A1* 6/2006 Tsukamoto ..... F21S 48/1159 362/518
2012/0294021 A1* 11/2012 Hessling ..... B64D 47/04 362/470

* cited by examiner

*Primary Examiner* — Evan Dzierzynski
(74) *Attorney, Agent, or Firm* — Li & Cai Intellectual Property (USA) Office

(57) ABSTRACT

Disclosed is a vehicle lamp structure including a lamp cup structure and a light-emitting structure. The lamp cup structure has a first light-reflecting surface and a second light-reflecting surface. The first light-reflecting surface has a first focal point and a second focal point. The second light-reflecting surface has a third focal point and a fourth focal point. The light-emitting structure includes a first light-emitting element and a second light-emitting element. The first light-emitting element corresponds to the first focal point. The second light-emitting element corresponds to the third focal point. The first light-emitting element generates a first light source projected onto the first light-reflecting surface to form a first reflection light source through the second focal point. The second light-emitting element generates a second light source projected onto the second light-reflecting surface to form a second reflection light source through the fourth focal point.

16 Claims, 11 Drawing Sheets

VEHICLE LAMP STRUCTURE

TECHNICAL FIELD

The present disclosure relates to a vehicle lamp structure, and in particular, to a vehicle lamp structure having multiple optical axes.

BACKGROUND ART

Light-emitting modules of conventional vehicle headlamps may be classified into tungsten halogen lamps and High Intensity Discharge (HID) lamps, where the tungsten halogen lamp has an arc length of 5.6 mm and the HID lamp has an arc length of 4.3 mm. In order to match with traditional illumination lamp sources, a Projector Ellipsoid System (PES) is most often used as a light-focusing system, where a lamp cup has the characteristic of a single optical axis and a single light-emitting module. At present, in order to match the arc lengths and sizes of a tungsten halogen lamp and an HID lamp, a light-emitting diode module disposed in the vehicle headlight adopts a continuous light-emitting diode packaging process. Further, because a single elliptical lamp cup only has a single focal point, only a single light-emitting diode can be used. Therefore, light-emitting diodes having a size of 1 mm×1 mm are most often adopted as the base of package at present. The continuous light-emitting diode packaging process means that light-emitting diodes are packaged on a same silicon substrate through a eutectic process or another process, so that the distance between the edges of the light-emitting diodes may be 0.1 mm and may even be as small as 0.05 mm. Because the space between the light-emitting diodes is small, the light-emitting diodes may be regarded as a single light source. However, with the same brightness, the cost of the continuous light-emitting diode package is at least 10 times more than a common light-emitting diode manufactured through a common process.

Meanwhile, referring to FIG. 1, a common light-emitting diode has a large package size and cannot be packaged and be used as a single light source. The light-emitting diodes L1, L2, L3, and L4 are mounted on a Metal Core Printed Circuit Board (MCPCB). Generally, a minimum edge distance R1 of the light-emitting diodes L1, L2, L3, and L4 is 0.15 mm to 0.2 mm. A minimum weldable spacing R2 of the light-emitting diodes L1, L2, L3, and L4 in a tin soldering process is 0.1 mm to 0.2 mm. Therefore, if common illumination light-emitting diodes each having a size of 1 mm×1 mm are discretely arranged and the distance R between adjacent ones in the light-emitting diodes L1, L2, L3, and L4 is 0.5 mm, multiple light sources are thus formed, thus failing to meet the regulatory requirements.

SUMMARY OF INVENTION

In view of the above problems, the present disclosure provides a vehicle lamp structure adopting a discontinuous light-emitting module, through the design of a lamp cup, which is adapted for a vehicle lamp structure adapting multiple discontinuous light-emitting diodes, so that the problems in the prior art are avoided, relevant regulations such as ECE R112 in the Regulations of United Nations Economic Commission for Europe (called ECE regulations for short) are met, and the manufacturing cost is reduced.

In order to achieve the above objective, an embodiment of the present disclosure provides a vehicle lamp structure including a lamp cup structure and a light-emitting structure.

The lamp cup structure has a first light-reflecting surface and a second light-reflecting surface, where the first light-reflecting surface has a first focal point and a second focal point, the second light-reflecting surface has a third focal point and a fourth focal point, and the second focal point and the fourth focal point converge with each other. The light-emitting structure includes a first light-emitting module and a second light-emitting module, where the first light-emitting module includes at least one first light-emitting element for generating a first light source, and the second light-emitting module includes at least one second light-emitting element for generating a second light source. The first light-reflecting surface and the second light-reflecting surface are separated from each other at a predetermined distance, the at least one of the first light-emitting element corresponds to the first focal point, and the at least one of the second light-emitting element corresponds to the third focal point. The first light source generated by the at least one first light-emitting element is projected onto the first light-reflecting surface to form a first reflection light source through the second focal point and the second light source generated by the at least one second light-emitting element is projected onto the second light-reflecting surface to form a second reflection light source through the fourth focal point.

Another embodiment of the present disclosure provides a lamp cup structure including a first light-reflecting surface and a second light-reflecting surface. The first light-reflecting surface has a first focal point and a second focal point, where the first focal point and the second focal point are located on a first optical axis. The second light-reflecting surface has a third focal point and a fourth focal point, where the third focal point and the fourth focal point are located on a second optical axis. The first light-reflecting surface and the second light-reflecting surface are separated from each other at a predetermined distance, the second focal point and the fourth focal point converge with each other, and the first optical axis and the second optical axis intersect with each other on a position where the second focal point and the fourth focal point converge with each other.

Another embodiment of the present disclosure provides a vehicle lamp structure including a lamp cup structure, a light-emitting structure, and a reflecting mirror. The lamp cup structure has a first light-focusing curved surface and a second light-focusing curved surface connected to the first light-focusing curved surface, where the first light-focusing curved surface has a first focal point and a second focal point, the second light-focusing curved surface has a third focal point and a fourth focal point, and the second focal point and the fourth focal point converge with each other. The light-emitting structure includes a first light-emitting module and a second light-emitting module, where the first light-emitting module includes at least one first light-emitting element for generating a first light source, and the second light-emitting module includes at least one second light-emitting element for generating a second light source. The at least one of the first light-emitting element corresponds to the first focal point, and the at least one of the second light-emitting element corresponds to the third focal point. The reflecting mirror is disposed between the first light-emitting module and the second light-emitting module immediately adjacent to the second light-emitting module. The first light source generated by the at least one first light-emitting element is projected onto the first light-focusing curved surface to form a first reflection light source through the second focal point, one part of the second light source generated by the at least one second light-emitting element is directly projected onto the second light-focusing curved surface to form a second reflection light source through the fourth focal point, and the other part of the second light source generated by the at least one second light-emitting element is successively reflected by the reflecting mirror and the second light-focusing curved surface to form a third reflection light source through the fourth focal point.

The beneficial effects of the present disclosure are in that, through the design of the lamp cup, the vehicle lamp structure provided by embodiments of the present disclosure is adapted for a vehicle lamp structure with discontinuous light-emitting modules, so that the problems in the prior art are avoided, relevant regulations such as ECE R112 in the Regulations of United Nations Economic Commission for Europe (called ECE regulations for short) are met, and the manufacturing cost is reduced.

In order to further understand the features and technical content of the present disclosure, reference may be made to the following detailed description and accompanying drawings of the present disclosure. However, the accompanying drawings are only provided for reference and illustration, but not are intended to limit the present disclosure.

DESCRIPTION OF THE EMBODIMENTS

First Embodiment

Figure 1:
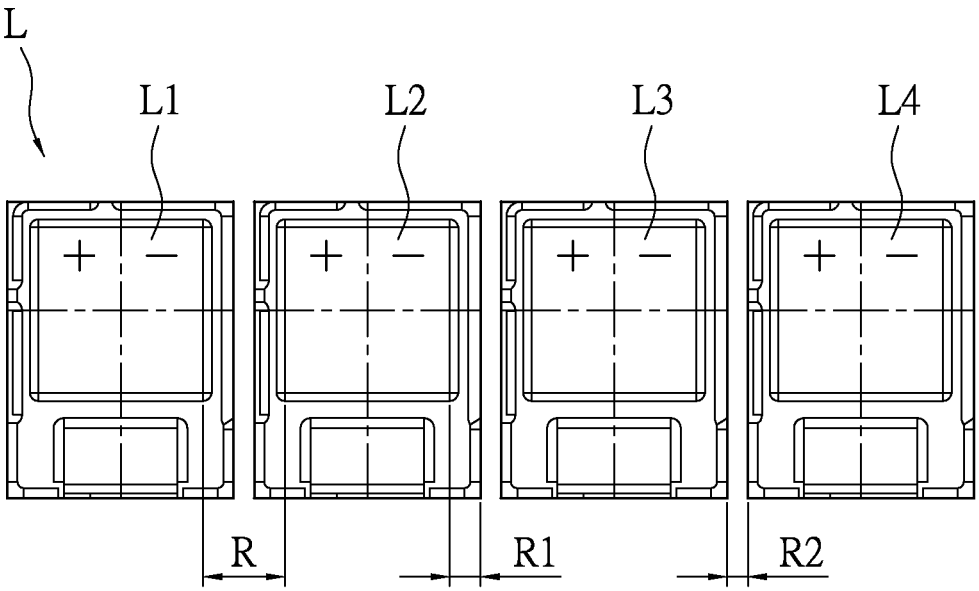
FIG.1 PRIOR ART
FIG. 1 is a schematic layout diagram of a discontinuous light-emitting module in the prior art.

Firstly, referring to FIG. 2A to FIG. 2D, a first embodiment of the present disclosure provides a vehicle lamp structure V, including a lamp cup structure 1 and a light-emitting structure 2. The lamp cup structure 1 has a first light-reflecting surface 11 and a second light-reflecting surface 12, where the first light-reflecting surface 11 has a first focal point F1 and a second focal point F2, the second reflecting surface 12 has a third focal point F3 and a fourth focal point F4, the second focal point F2 and the fourth focal point F4 converge with each other, and the first light-reflecting surface 11 and the second light-reflecting surface 12 may be separated from each other at a predetermined distance. For example, the first light-reflecting surface 11 and the second light-reflecting surface 12 may be of an ellipse shape. Moreover, the lamp cup structure 1 may further have a light-diffusing surface 13 (or light-spreading surface) disposed or connected between the first light-reflecting surface 11 and the second light-reflecting surface 12, but the present disclosure is not limited thereto.

Figure 2A:
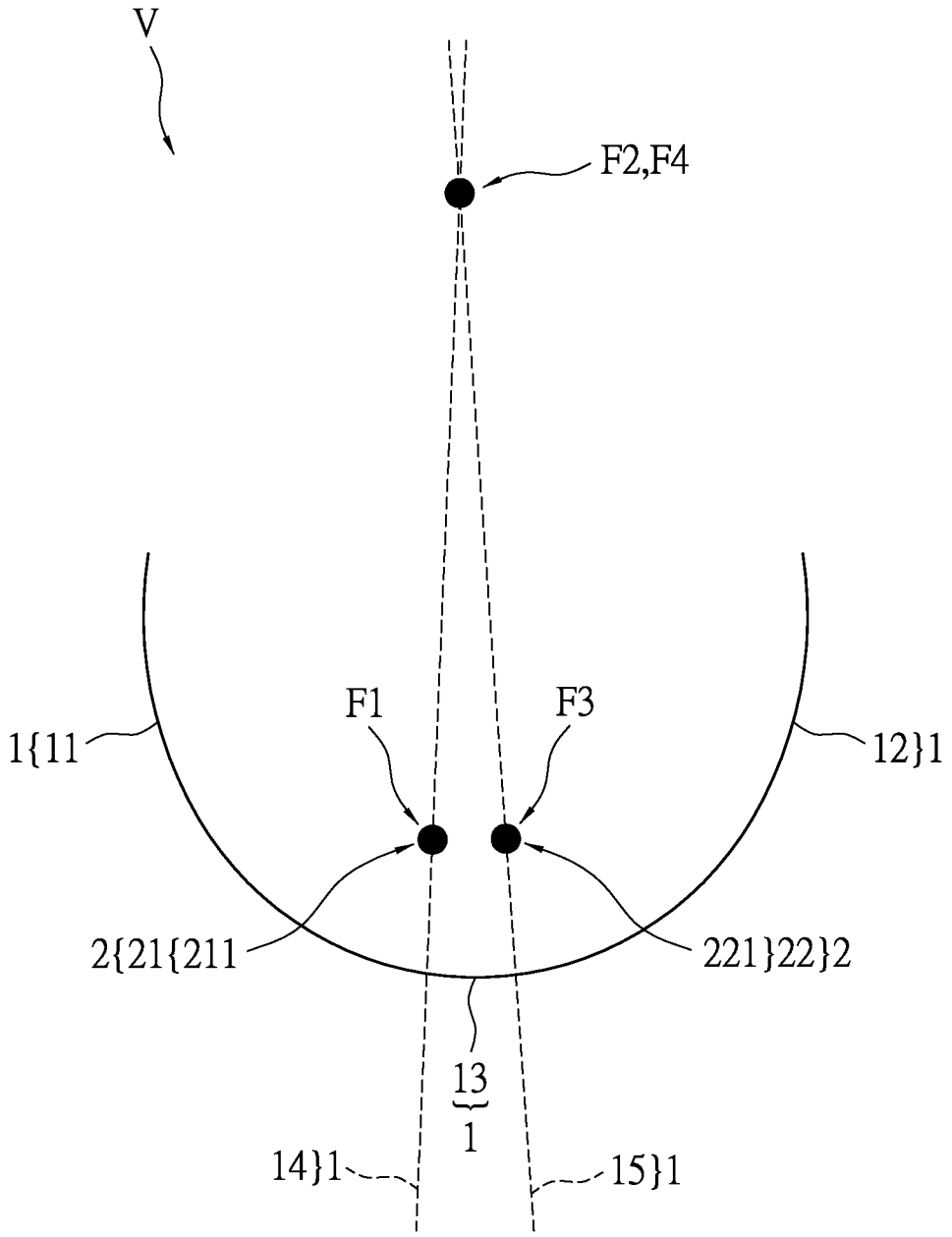
FIG. 2A is a schematic structural diagram of a vehicle lamp structure according to a first embodiment of the present disclosure.
Figure 2B:
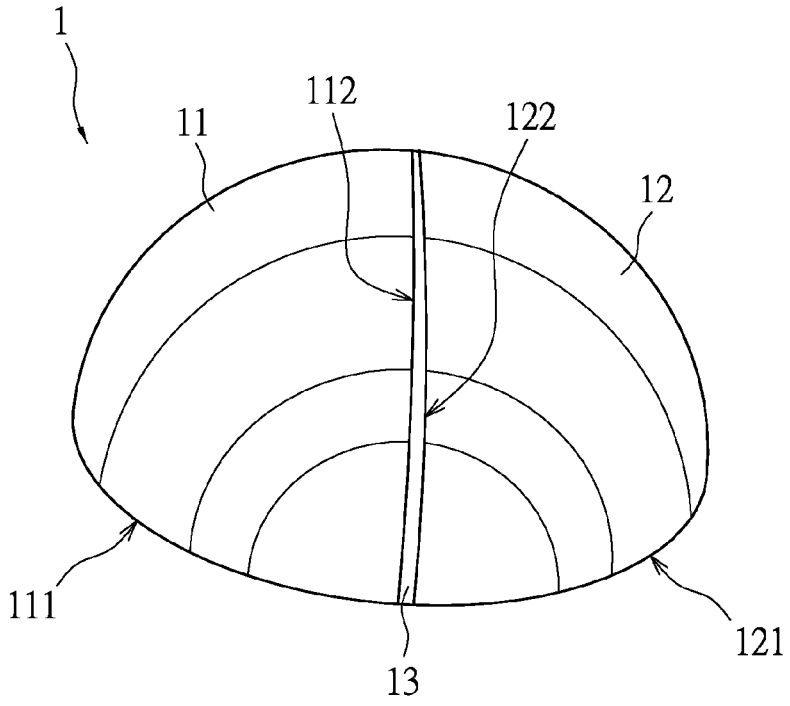
FIG. 2B is a schematic three-dimensional structural diagram of a lamp cup structure according to a first embodiment of the present disclosure.

Referring to FIG. 2B, the first light-reflecting surface 11 may consist of a first horizontal base line 111 and a first vertical base line 112, and the second light-reflecting surface 12 may consist of a second horizontal base line 121 and a second vertical base line 122. The first horizontal base line 111, the first vertical base line 112, the second horizontal base line 121, and the second vertical basic line 122 may be elliptical line segments. The first horizontal base line 111 and the first vertical base line 112 may have the common first focal point F1 or second focal point F2 and may also have different first focal points F1 and second focal points F2. Similarly, the second horizontal base line 121 and the second vertical base line 122 may have the common third focal point F3 or fourth focal point F4 and may also have different third focal points F3 or fourth focal points F4.

Referring to FIG. 2A, the light-emitting structure 2 may be disposed in the lamp cup structure 1. The light-emitting structure 2 includes a first light-emitting module 21 and a second light-emitting module 22. The first light-emitting module 21 may include multiple first light-emitting elements 211 for generating a first light source or may have only one first light-emitting element 211. The second light-emitting module 22 may include multiple second light-emitting elements 221 for generating a second light source or may have only one second light-emitting element 221. For example, the first light-emitting elements 211 and the second light-emitting elements 221 are light-emitting diodes. The first light-emitting module 21 and the second light-emitting module 22 may each adopt light-emitting diodes with different color temperatures or colored light to adjust a light source emitted by the light-emitting structure 2. When the multiple first light-emitting elements 211 are adopted, at least one of the multiple first light-emitting elements 211 is arranged at the first focal point F1. When the multiple second light-emitting elements 221 are adopted, at least one of the multiple second light-emitting elements 221 is arranged at the third focal point F3. For example, at least one of the multiple first light-emitting elements 211 may be disposed adjacent to the first focal point F1 and at least one of the multiple second light-emitting elements 221 may be disposed adjacent to the third focal point F3. Alternatively, at least one of the multiple first light-emitting elements 211 may be directly disposed at the first focal point F1 and at least one of the multiple second light-emitting elements 221 may be directly disposed at the third focal point F3. Further, at least one of the multiple first light-emitting elements 211 may also be directly disposed at the first focal point F1 and at least one of the multiple second light-emitting elements 221 may also be disposed adjacent to the third focal point F3. Therefore, the light distribution pattern and the light brightness are changed by changing the positions of the light-emitting elements and the light-reflecting surface focal points. Moreover, a control module may be used to control the turn-on or turn-off of the first light-emitting module 21 and the second light-emitting module 22 and thus control the light distribution pattern, color temperature or colored light of the light source emitted by the light-emitting structure 2. It should be noted that, the first light-emitting module 21 and the second light-emitting module 22 used in the present disclosure may each have only one light-emitting element and are not limited to having multiple light-emitting elements. In addition, the first light-emitting module 21 and the second light-emitting module 22 may also be a light-emitting module L consisting of multiple light-emitting diodes formed on a same substrate.

Figure 2C:
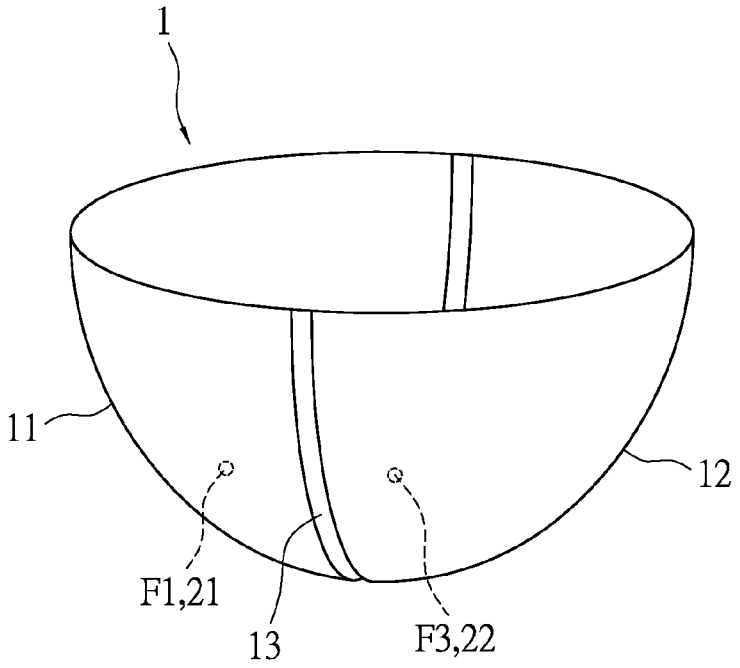
FIG. 2C is another schematic three-dimensional structural diagram of the lamp cup structure of the present disclosure.

Also referring to FIG. 2C, when the control module turns on the light-emitting structure 2, the first light source generated by the at least one first light-emitting element 211 in the first light-emitting module 21 is projected onto the first light-reflecting surface 11 to form a first reflection light source passing through the second focal point F2 and the second light source generated by the at least one second light-emitting element 221 in the second light-emitting module 22 is projected onto the second light-reflecting surface 12 to form a second reflection light source passing through the fourth focal point F4. In other words, because the first light-emitting element 211 is correspondingly disposed at the first focal point F1 and the second light-emitting element 221 is correspondingly disposed at the third focal point F3, in combination with the curve characteristic of the light-reflecting surfaces, the first light source generated by the first light-emitting element 211 focuses on the second focal point F2 of the first light-reflecting surface 11 after being reflected by the first light-reflecting surface 11 and the second light source generated by the second light-emitting element 221 focuses on the fourth focal point F4 of the second light-reflecting surface 12 after being reflected by the second light-reflecting surface 12. Moreover, the first reflection light source and the second reflection light source may be projected through a plano-convex lens which has a focal point located at the second focal point F2 and the fourth focal point F4. In this case, the first light-reflecting surface 11 has a focusing function for the first light-emitting module 21 and the first light-reflecting surface 11 has a light-diffusing function for the second light-emitting module 22. Similarly, the second light-reflecting surface 12 has the focusing function for the second light-emitting module 22 and the second light-reflecting surface 12 has the light-diffusing function for the first light-emitting module 21. The light-diffusing surface 13 does not have the focusing function for the first light-emitting module 21 and the second light-emitting module 22, but can diffuse the light generated by the first light-emitting module 21 and the second light-emitting module 22.

As shown in FIG. 2A to FIG. 2C, the lamp cup structure 1 may further include a first optical axis 14 and a second optical axis 15. The first optical axis 14 passes through the first focal point F1 and the second focal point F2 of the first light-reflecting surface 11. The second optical axis 15 passes through the third focal point F3 and the fourth focal point F4 of the second light-reflecting surface 12. The first optical axis 14 and the second optical axis 15 intersect with each other on the second focal point F2 and the fourth focal point F4. The first optical axis 14 and the second optical axis 15 each are respectively coplanar with the plane formed by their vertical base lines. Moreover, when the lamp cup structure 1 cooperates with a plano-convex lens, a focal point of which is disposed at the second focal point F2 and the fourth focal point F4, so that the light source focusing on the second focal point F2 and the fourth focal point F4 is emitted through the plano-convex lens, where an optical axis of the plano-convex lens is located between the first optical axis 14 and the second optical axis 15. Furthermore, a cut-off line shielding plate may be further disposed adjacent to or directly at the focal point of the plano-convex lens, or disposed adjacent to or directly at the second focal point F2 and the fourth focal point F4 of the lamp cup structure 1.

Figure 2D:
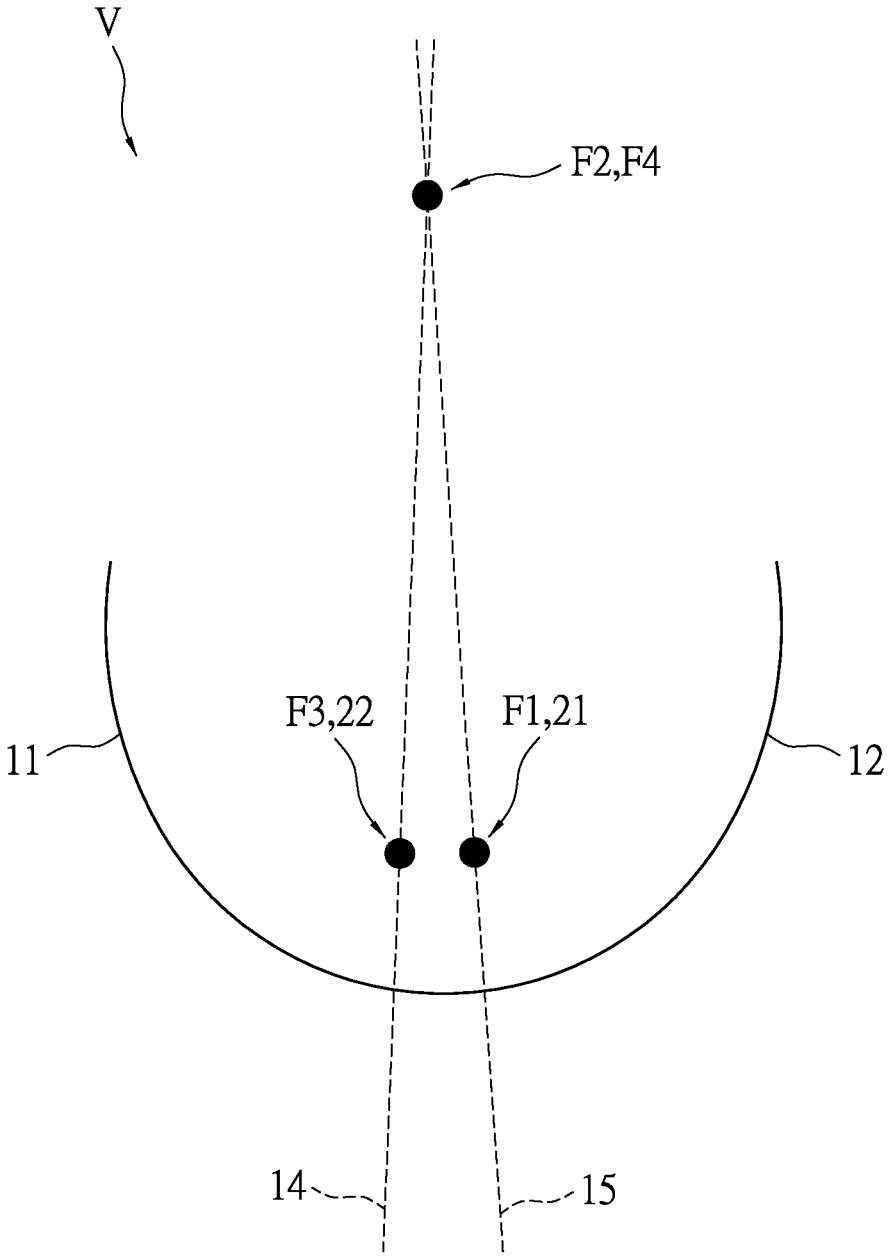
FIG. 2D is a schematic structural diagram of the vehicle lamp structure of the present disclosure.

Referring to FIG. 2D, by changing curved surfaces of the first light-reflecting surface 11 and the second light-reflecting surface 12, the first focal point F1 of the first light-reflecting surface 11 falls between the second light-reflecting surface 12 and the third focal point F3, and the third focal point F3 of the second light-reflecting surface 12 falls between the first light-reflecting surface 11 and the first focal point F1. In the embodiment of FIG. 2D, the lamp cup structure 1 may only have the first light-reflecting surface 11 and the second light-reflecting surface 12, but not have the light-diffusing surface 13. Moreover, when the lamp cup structure 1 cooperates with a plano-convex lens, a focal point of which is disposed at the second focal point F2 and the fourth focal point F4, so that the light source focusing on the second focal point F2 and the fourth focal point F4 is emitted through the plano-convex lens, where an optical axis of the plano-convex lens is located between the first optical axis 14 and the second optical axis 15. Furthermore, a cut-off line shielding plate may be further disposed adjacent to or directly at the focal point of the plano-convex lens, or disposed adjacent to or directly at the second focal point F2 and the fourth focal point F4 of the lamp cup structure 1.

Figure 2E:
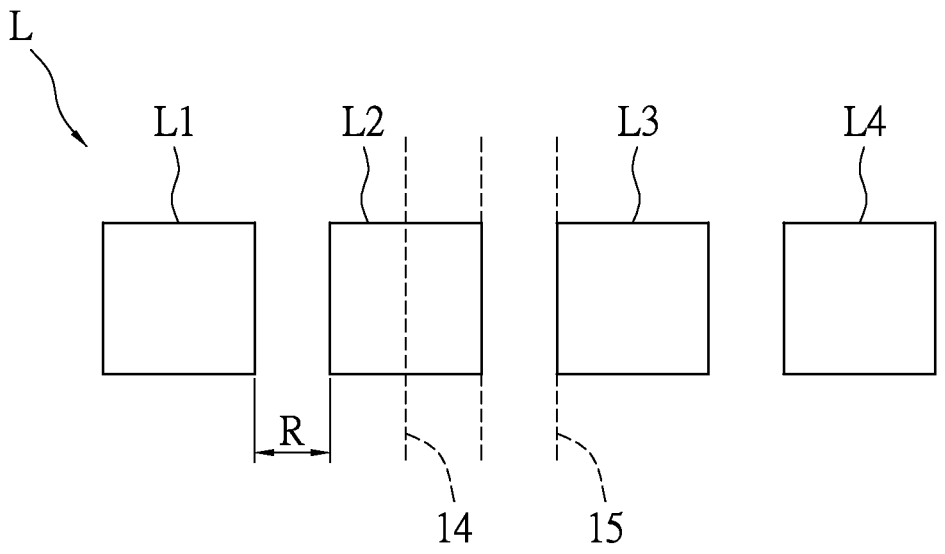
FIG. 2E is a schematic layout diagram of a light-emitting module of the present disclosure.

Also referring to FIG. 2E, a light-emitting module L shown in FIG. 2E may be disposed in the lamp cup structure 1 shown in FIG. 2A, or four separate light-emitting diodes may also be disposed in the lamp cup structure 1. The light-emitting module L consists of four light-emitting diodes L1, L2, L3, and L4 each having a size of 1 mm×1 mm. The distance R between adjacent ones of the light-emitting diodes L1, L2, L3, and L4 is 0.5 mm. The first optical axis 14 passes through the first focal point F1 and the second focal point F2 of the first light-reflecting surface 11. The second optical axis 15 passes through the third focal point F3 and the fourth focal point F4 of the second light-reflecting surface 12. The first optical axis 14 passes through the light-emitting diode L2 and the second optical axis 15 passes along an edge of the light-emitting diode L3. Therefore, for the first light-reflecting surface 11, the light-emitting diode L2 generates a focused light pattern; for the second light-reflecting surface 12, a diffused light pattern is generated because the second optical axis 15 does not pass through the light-emitting diode L2. In this embodiment, if the parameters of the first light-reflecting surface 11 and the second light-reflecting surface 12 are set as follows: the distance from a line segment vertex (not a vertex of the light-diffusing surface 13) of the first light-reflecting surface 11 to the first focal point F1 is 10 mm, the distance from a line segment vertex (not the vertex of the light-diffusing surface 13) of the second light-reflecting surface 12 to the third focal point F3 is 10 mm, the distance between the first focal point F1 and the second focal point F2 is 50 mm, the distance between the third focal point F3 and the fourth focal point F4 is 50 mm, and the length of the lamp cup structure 1 is 35 mm, an emitted light source can have a light pattern complying with the regulations, the illuminance and the lumens can be improved, and the bright area can be concentrated, thereby helping a dipped headlight to project to a farther distance.

Figure 3A:
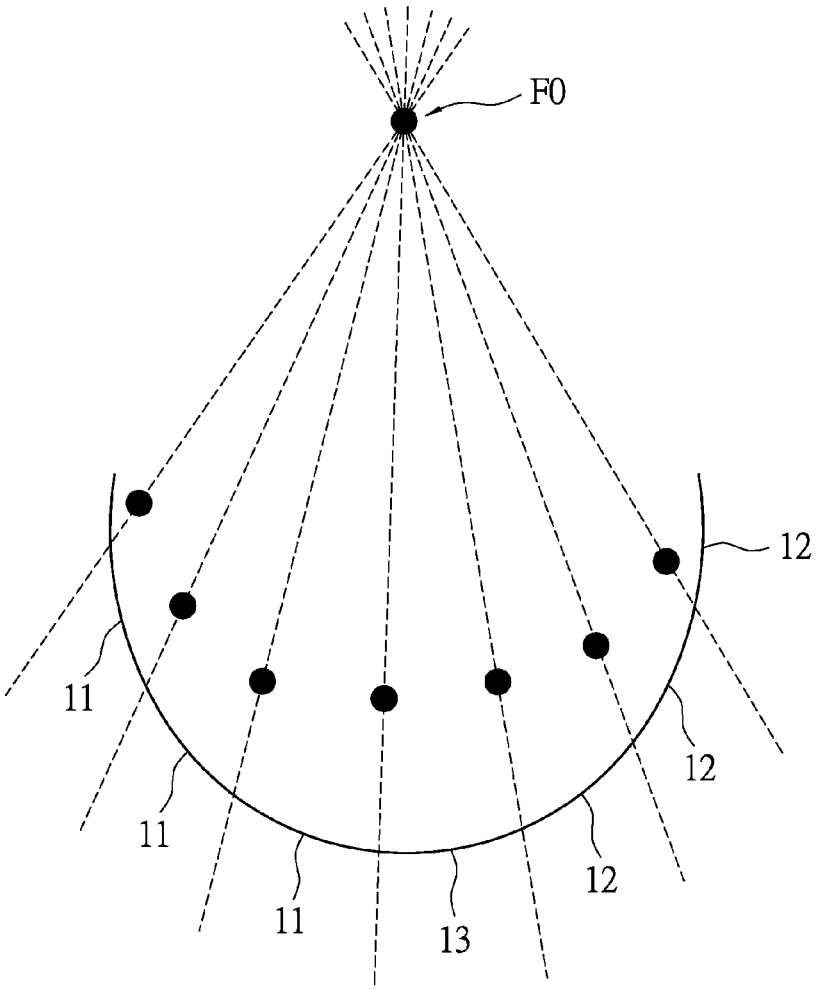
FIG. 3A is a schematic structural diagram of the vehicle lamp structure of the present disclosure.

Referring to FIG. 3A, the lamp cup structure 1 consists of multiple curved surfaces with different curvatures. For example, the first light-reflecting surface 11 may have multiple light-focusing curved surfaces (or light-condensing curved surface). Each of the light-focusing curved surfaces of the first reflecting surface 11 has a focal point. The multiple first light-emitting elements 211 are disposed at the multiple focal points of the light-focusing curved surfaces, respectively. The second light-reflecting surface 12 may have multiple light-focusing curved surfaces. Each of the light-focusing curved surfaces has a focal point. The multiple second light-emitting elements 221 are disposed on the multiple focal points of the light-focusing curved surfaces, respectively. Therefore, each light-focusing curved surface has a focal point and an optical axis. The optical axes of the light-focusing curved surfaces intersect on a common focal point F0. Each light-focusing curved surface has a horizontal base line and a vertical base line. The focal point of the plano-convex lens also converges with the common focal point F0.

Figure 3B:
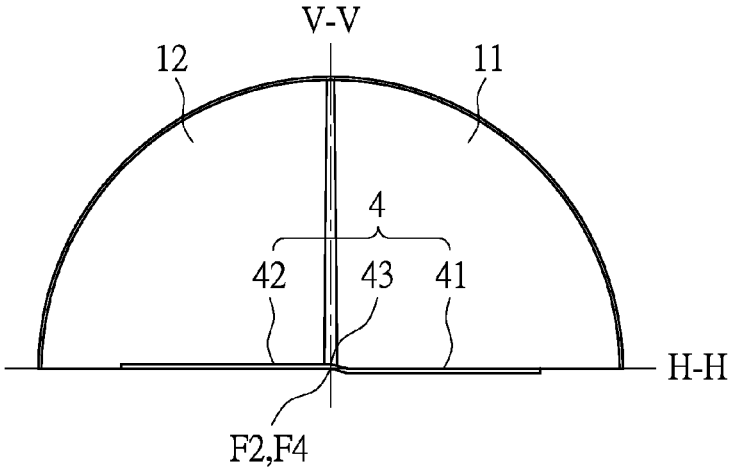
FIG. 3B is a schematic structural diagram of the vehicle lamp structure of the present disclosure.

Referring to FIG. 3B, the relationship between a cut-off line shielding plate 4 and the first light-reflecting surface 11 and the second reflecting surface 12 is revealed in FIG. 3B. The cut-off line shielding plate 4 is disposed at the second focal point F2 of the first light-reflecting surface 11 and the fourth focal point F4 of the second light-reflecting surface 12. The second focal point F2 and the fourth focal point F4 are located at an intersection point of an H-H line and a V-V line. Therefore, the cut-off line shielding plate 4 will shield the second focal point F2 and the fourth focal point F4. The cut-off line shielding plate 4 has a first horizontal portion 41 and a second horizontal portion 42. The first horizontal portion 41 and the second horizontal portion 42 are connected through an oblique plane portion 43. The first horizontal portion 41 is located at the right side of the V-V line. A plane (facing the direction of the lamp cup) of the first horizontal portion 41 converges with the H-H line or is spaced from the H-H line at a distance in a direction away from the lamp cup. The second horizontal portion 42 is located at the left side of the V-V line. A plane of the second horizontal portion 42 is located above the H-H line and shields some of the light reflected by the lamp cup structure 1. The oblique plane portion 43 located between the first horizontal portion 41 and the second horizontal portion 42 is a turning part of the cut-off line, which deflects lights along V-V line with an angle of 165 degrees.

Figure 4A:
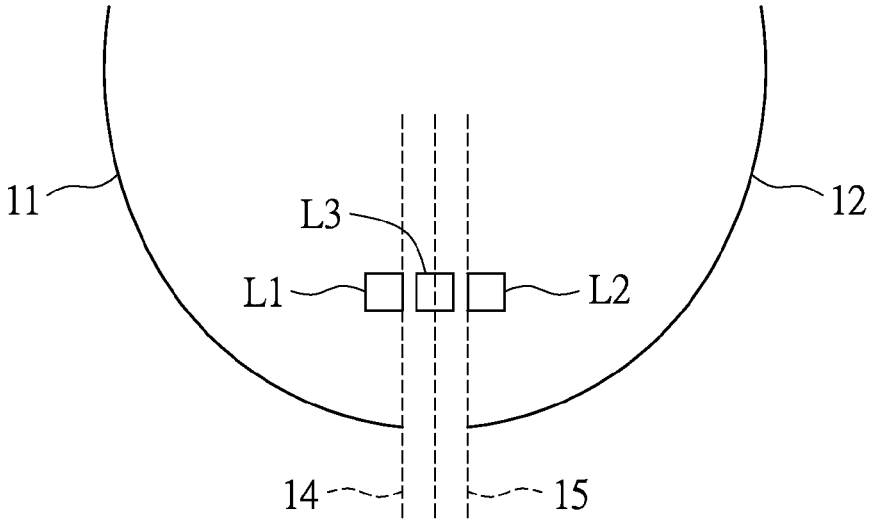
FIG. 4A is a schematic structural diagram of the vehicle lamp structure of the present disclosure.
Figure 4B:
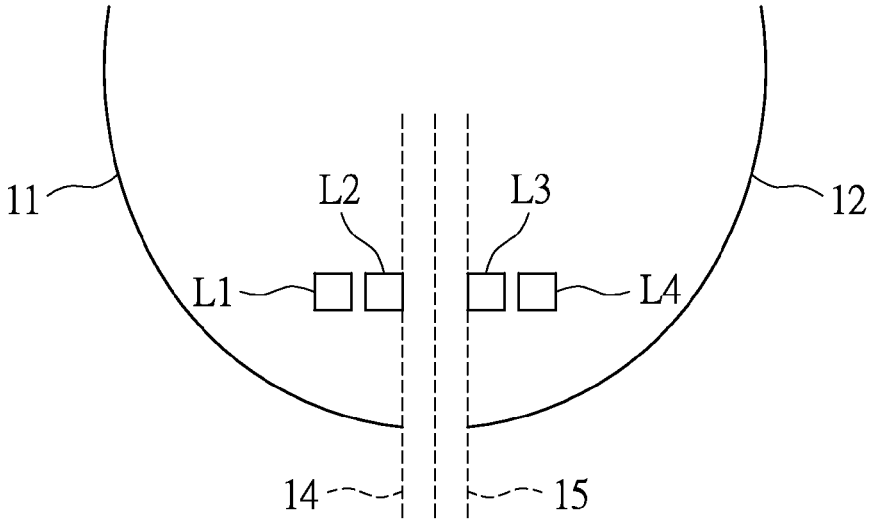
FIG. 4B is a schematic structural diagram of the vehicle lamp structure of the present disclosure.
Figure 4C:
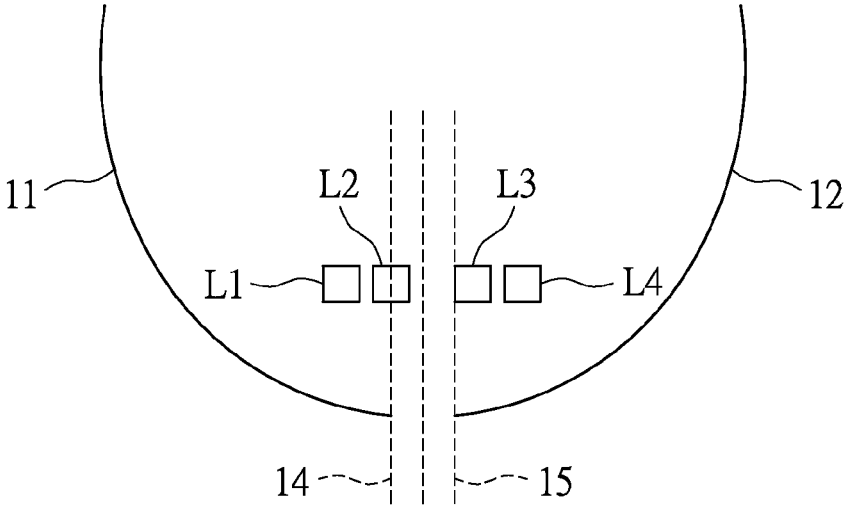
FIG. 4C is a schematic structural diagram of the vehicle lamp structure of the present disclosure.
Figure 4D:
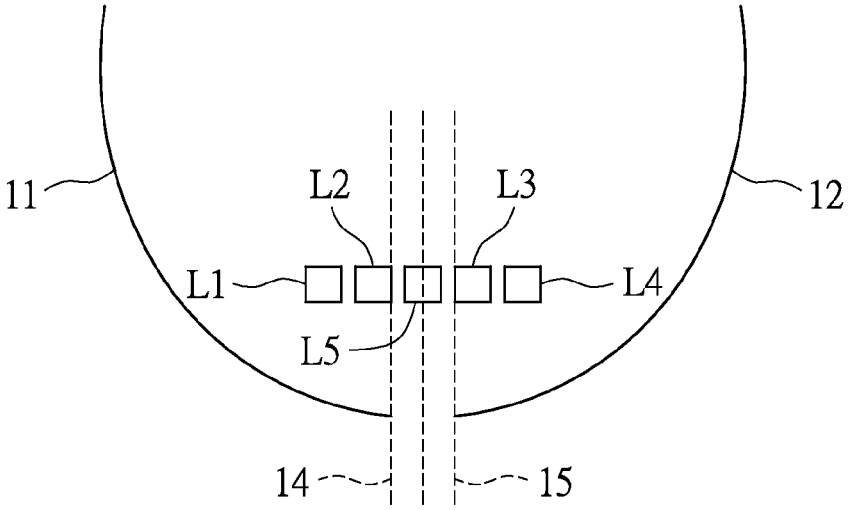
FIG. 4D is a schematic structural diagram of the vehicle lamp structure of the present disclosure.

Referring to FIG. 4A to FIG. 4D, different numbers of light-emitting diodes L1, L2, L3, L4, and L5 are adopted in the vehicle lamp structure V and are arranged corresponding to the focal points of the first light-reflecting surface 11 and the second light-reflecting surface 12 in different ways. As shown in FIG. 4A, the light-emitting module L consists of three light-emitting diodes L1, L2, and L3 each having a size of 1 mm×1 mm. The first optical axis 14 passes along a left side or right side edge of the light-emitting diode L1. The second optical axis 15 passes along a left side or right side edge of the light-emitting diode L2. The light-emitting diode L3 is disposed on a central axis of the lamp cup structure 1. As shown in FIG. 4B, the light-emitting module L consists of four light-emitting diodes L1, L2, L3, and L4 each having a size of 1 mm×1 mm. The first optical axis 14 passes along a left side or right side edge of the light-emitting diode L2. The second optical axis 15 passes along a left side or right side edge of the light-emitting diode L3. The light-emitting diodes L1 and L4 may be used for the light-diffusing function. As shown in FIG. 4C, the light-emitting module L consists of four light-emitting diodes L1, L2, L3, and L4 each having a size of 1 mm×1 mm. The first optical axis 14 passes through the light-emitting diode L2. The second optical axis 15 passes along a left side or right side edge of the light-emitting diode L3. The light-emitting diodes L1 and L4 may be used for the light-diffusing function. As shown in FIG. 4D, the light-emitting module L consists of five light-emitting diodes L1, L2, L3, L4, and L5 each having a size of 1 mm×1 mm. The first optical axis 14 passes along a left side or right side edge of the light-emitting diode L2. The second optical axis 15 passes along a left side or right side edge of the light-emitting diode L3. The light-emitting diode L5 is disposed on the central axis of the lamp cup structure 1. The light-emitting diodes L1, L4 and L5 may be used for the light spreading function.

Figure 5:
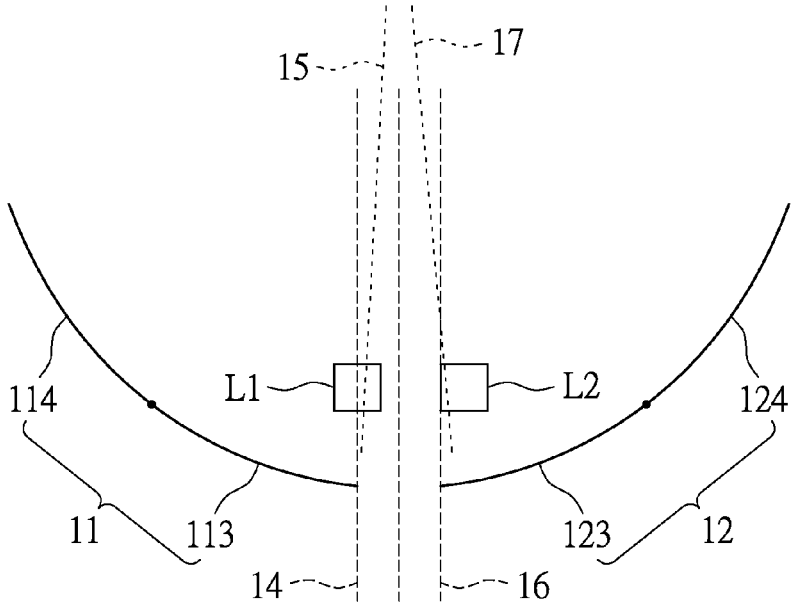
FIG. 5 is a schematic structural diagram of the vehicle lamp structure of the present disclosure.

Referring to FIG. 5, the lamp cup structure 1 may have a first light-reflecting surface 11 and a second light-reflecting surface 12. The first light-reflecting surface 11 may have a first light-focusing curved surface 113 and a second light-focusing curved surface 114. The second light-reflecting surface 12 may have a third light-focusing curved surface 123 and a fourth light-focusing curved surface 124. The first light-focusing curved surface 113 has a first optical axis 14, the second light-focusing curved surface 114 has a second optical axis 15, the third light-focusing curved surface 123 has a third optical axis 16, and the fourth light-focusing curved surface 124 has a fourth optical axis 17. Then, the light-emitting diodes L1 and L2 may be correspondingly disposed at a focal point of the first light-focusing curved surface 113 and a focal point of the third light-focusing curved surface 123. For example, the first optical axis 14 passes through the light-emitting diode L1, the second optical axis 15 may pass along a left side or right side edge of the light-emitting diode L1, the third optical axis 16 may pass along a left side or right side edge of the light-emitting diode L2, and the fourth optical axis 17 may pass along the left side or right side edge of the light-emitting diode L2.

Because the curvatures of the first light-reflecting surface 11 and the second light-reflecting surface 12 in the lamp cup structure 1 may be designed and the light-emitting structure 2 may be correspondingly disposed at the focal points of the first light-reflecting surface 11 and the second light-reflecting surface 12, the vehicle lamp structure V provided by the first embodiment of the present disclosure is especially applicable to a vehicle lamp structure V with a discontinuous light-emitting module L, so that relevant regulations such as ECE R112 in the Regulations of United Nations Economic Commission for Europe (called ECE regulations for short) are met, the manufacturing cost is reduced, and the illuminance, the lumens, and the projection distance of the light source are improved.

Second Embodiment

Referring to FIG. 2A, a second embodiment of the present disclosure provides a lamp cup structure 1, including a first light-reflecting surface 11 and a second light-reflecting surface 12. The first light-reflecting surface 11 has a first focal point F1 and a second focal point F2. The first focal point F1 and the second focal point F2 are located on a first optical axis 14. The second light-reflecting surface 12 has a third focal point F3 and a fourth focal point F4. The third focal point F3 and the fourth focal point F4 are located on a second optical axis 15. The first light-reflecting surface 11 and the second light-reflecting surface 12 may be separated from each other at a predetermined distance. The second focal point F2 and the fourth focal point F4 converge with each other. The first optical axis 14 and the second optical axis 15 intersect with each other on a position where the second focal point F2 and the fourth focal point F4 converge with each other. For example, the first light-reflecting surface 11 and the second light-reflecting surface 12 may be of an elliptical shape. Moreover, the lamp cup structure 1 may further have a light-diffusing surface 13 disposed or connected between the first light-reflecting surface 11 and the second light-reflecting surface 12. Moreover, the lamp cup structure 1 may further include a first optical axis 14 and a second optical axis 15. The first optical axis 14 passes through the first focal point F1 and the second focal point F2 of the first light-reflecting surface 11. The second optical axis 15 passes through the third focal point F3 and the fourth focal point F4 of the second light-reflecting surface 12. The first optical axis 14 and the second optical axis 15 intersect with each other at the second focal point F2 and the fourth focal point F4. The first optical axis 14 and the second optical axis 15 each are respectively coplanar with the plane formed by their vertical base lines. However, the present disclosure is not limited thereto.

Referring to FIG. 2B, the first light-reflecting surface 11 may consist of a first horizontal base line 111 and a first vertical base line 112 and the second light-reflecting surface 12 may consist of a second horizontal base line 121 and a second vertical base line 122. The first horizontal base line 111, the first vertical base line 112, the second horizontal base line 121, and the second vertical base line 122 may be of elliptical line segments. The first horizontal base line 111 and the first vertical base line 112 may have the common first focal point F1 or second focal point F2 and may also have different first focal points F1 and second focal points F2. Similarly, the second horizontal basic line 121 and the second vertical basic line 122 may have the common third focal point F3 or fourth focal point F4 and may also have different third focal points F3 or fourth focal points F4.

Then, referring to FIG. 2C, light-emitting elements may be disposed in the lamp cup structure 1. Therefore, the lamp cup structure 1 includes at least one first light-emitting element 211 and at least one second light-emitting element 221. At least one first light-emitting element 211 is disposed adjacent to or directly at the first focal point F1. At least one second light-emitting element 221 is disposed adjacent to or directly at the third focal point F3.

Referring to FIG. 4A to FIG. 4D, light-emitting diodes L1, L2, L3, L4, and L5 may be disposed in the lamp cup structure 1 disclosed in the second embodiment of the present invention. Different numbers of light-emitting diodes L1, L2, L3, L4, and L5 are adopted in the lamp cup structure 1 and are arranged corresponding to focal points of the first light-reflecting surface 11 and the second light-reflecting surface 12 in different ways. As shown in FIG. 4A, a light-emitting module L consists of three light-emitting diodes L1, L2, and L3 each having a size of 1 mm×1 mm. The first optical axis 14 passes along a left side or right side edge of the light-emitting diode L1. The second optical axis 15 passes along a left side or right side edge of the light-emitting diode L2. The light-emitting diode L3 is disposed on a central axis of the lamp cup structure 1. As shown in FIG. 4B, the light-emitting module L consists of four light-emitting diodes L1, L2, L3, and L4 each having a size of 1 mm×1 mm. The first optical axis 14 passes along a left side or right side edge of the light-emitting diode L2. The second optical axis 15 passes along a left side or right side edge of the light-emitting diode L3. As shown in FIG. 4C, the light-emitting module L consists of four light-emitting diodes L1, L2, L3, and L4 each having a size of 1 mm×1 mm. The first optical axis 14 passes through the light-emitting diode L2. The second optical axis 15 passes along a left side or right side edge of the light-emitting diode L3. As shown in FIG. 4D, the light-emitting module L consists of five light-emitting diodes L1, L2, L3, L4, and L5 each having a size of 1 mm×1 mm. The first optical axis 14 passes along a left side or right side edge of the light-emitting diode L2. The second optical axis 15 passes along a left side or right side edge of the light-emitting diode L3. The light-emitting diode L5 is disposed on the central axis of the lamp cup structure 1. It should be noted that, the disposing manner for the light-emitting diodes L1, L2, L3, L4, and L5 is not limited to the horizontal arrangement manner shown in FIG. 4A to FIG. 4D. For example, for FIG. 4C, the light-emitting diodes L1 and L2 are disposed at the left side of a symmetry axis, the light-emitting diode L2 may be disposed on the first optical axis 14 and not directly disposed at the first focal point F1 but adjacent to the first focal point F1, and the light-emitting diode L1 may be disposed at the left side of the first optical axis 14 and located behind the light-emitting diode L2. Therefore, when the light-emitting diodes L1 and L2 are disposed adjacent to the first focal point F1 in this aspect, the light source projected by the light-emitting diodes L1 and L2 through a plano-convex lens may be darker than that obtained when the light-emitting diodes L1 and L2 are directly disposed at the first focal point F1. Moreover, the light-emitting diodes L3 and L4 are disposed at the right side of the symmetry axis, the light-emitting diode L3 is disposed adjacent to the third focal point F3, the second optical axis 15 passes along the left side of the light-emitting diode L3, and a central point of the light-emitting diode L3 is disposed on a connection line of the first focal point F1 and the third focal point F3. The light-emitting diode L4 is similarly disposed adjacent to the third focal point F3, and is located behind the light-emitting diode L3, where not a center of the light-emitting diode L4 directly passes through the connection line of the first focal point F1 and the third focal point F3, but a partial edge of the light-emitting diode L4 passes through the connection line of the first focal point F1 and the third focal point F3. Therefore, the light source projected by the light-emitting diodes L1, L2, L3, and L4 through the plano-convex lens can comply with the ECE R112 regulation and the projected light source is dark at the left side and bright at the right side.

Referring to FIG. 3A, the lamp cup structure 1 consists of multiple curved surfaces with different curvatures. For example, the first light-reflecting surface 11 may have multiple light-focusing curved surfaces. Each of the light-focusing curved surfaces of the first light-reflecting surface 11 has a focal point. The multiple first light-emitting elements 211 are disposed on the multiple focal points of the light-focusing curved surfaces, respectively. The second light-reflecting surface 12 may have multiple light-focusing curved surfaces. Each of the light-focusing curved surfaces has a focal point. The multiple second light-emitting elements 221 are disposed on the multiple focal points of the light-focusing curved surfaces, respectively. Therefore, each light-focusing curved surface has a focal point and an optical axis. The optical axes of the light-focusing curved surfaces intersect on a common focal point F0. Each light-focusing curved surface has a horizontal base line and a vertical base line. A focal point of the plano-convex lens also converges with the common focal point F0.

Because the curvatures of the light-focusing curved surfaces of the first light-reflecting surface 11 and the second light-reflecting surface 12 in the lamp cup structure 1 may be set in advance and the light-emitting structure 2 may be correspondingly disposed at the focal points of the light-focusing curved surfaces, the lamp cup structure 1 provided by the second embodiment of the present disclosure is especially applicable to a discontinuous light-emitting diode package structure.

Third Embodiment

Figure 6A:
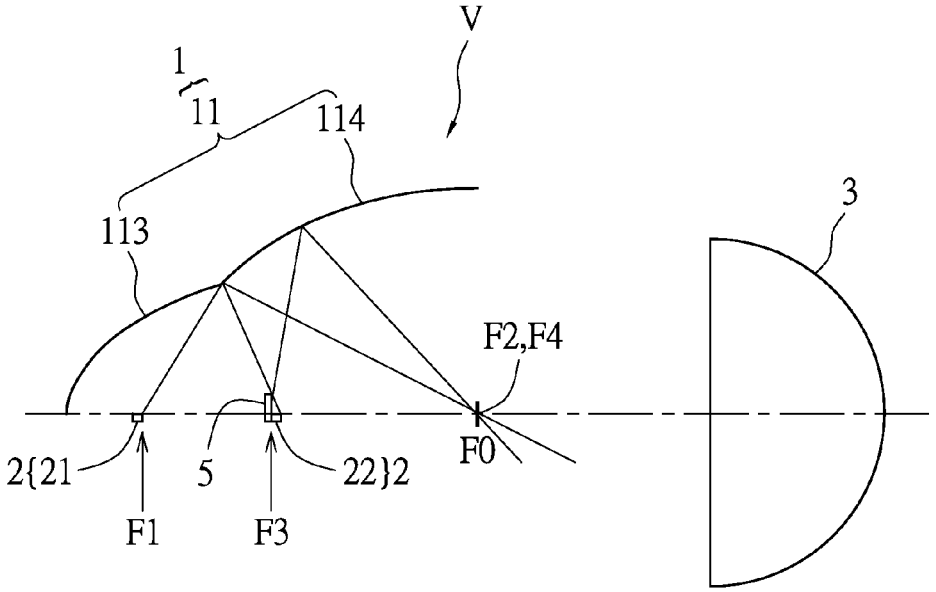
FIG. 6A is a schematic structural diagram of a vehicle lamp structure according to a third embodiment of the present disclosure.

Referring to FIG. 6A, a third embodiment of the present disclosure provides a vehicle lamp structure V, including a lamp cup structure 1, a light-emitting structure 2, and a reflecting mirror 5. In the third embodiment, the lamp cup structure 1 is similar to that in the first and second embodiments. The biggest difference between the third embodiment and the first embodiment is that, in the third embodiment, the curvatures of a first light-focusing curved surface 113 and a second light-focusing curved surface 114 on a first light-reflecting surface 11 are changed so that disposing positions of a first light-emitting module 21 and a second light-emitting module 22 correspond to a central axis of the lamp reflector structure 1. For example, the lamp cup structure 1 has a first light-focusing curved surface 113 and a second light-focusing curved surface 114 connected to the first light-focusing curved surface 113. The first light-focusing curved surface 113 has a first focal point F1 and a second focal point F2. The second light-focusing curved surface 114 has a third focal point F3 and a fourth focal point F4. The second focal point F2 and the fourth focal point F4 converge with each other. The light-emitting structure 2 includes a first light-emitting module 21 and a second light-emitting module 22. The first light-emitting module 21 may include multiple first light-emitting elements 211 for generating a first light source or may have only one light-emitting element. The second light-emitting module 22 may include multiple second light-emitting elements 211 for generating a second light source or may have only one light-emitting element. At least one of the multiple first light-emitting elements 211 corresponds to the first focal point F1 and at least one of the multiple second light-emitting elements 221 corresponds to the third focal point F3. Moreover, in the third embodiment, a reflecting mirror 5 may be disposed between the first light-emitting module 21 and the second light-emitting module 22 immediately adjacent to the second light-emitting module 22 to reflect a light source of the light-emitting module. Therefore, through the arrangement manner of the first light-focusing curved surface 113, the second light-focusing curved surface 114, the first light-emitting module 21, and the second light-emitting module 22, the first light source generated by the at least one first light-emitting element 211 is projected onto the first light-focusing curved surface 113 to form a first reflection light source through the second focal point F2, one part of the second light source generated by the at least one second light-emitting element 221 is directly projected onto the second light-focusing curved surface 114 to form a second reflection light source through the fourth focal point F4, and the other part of the second light source generated by the at least one second light-emitting element 221 is successively reflected by the reflecting mirror 5 and the second light-focusing curved surface 114 to form a third reflection light source through the fourth focal point F4. In this embodiment, the reflecting mirror 5 can reflect a light ray originally reflected onto the first light-focusing curved surface 113 onto the second light-focusing curved surface 114. The light ray reflected by the reflecting mirror 5 is a light ray emitted by a virtual image of the second light-emitting module 22 in the reflecting mirror 5, so the light ray may also focus at the second focal point F2 and the fourth focal point F4. For example, if the third focal point F3 of the second light-focusing curved surface 114 is located at a junction between the second light-emitting module 22 and the reflecting mirror 5, a light ray from the second light-emitting module 22 and a light ray from the virtual image fall at two sides of the fourth focal point F4.

Moreover, when the lamp cup structure 1 further cooperates with a plano-convex lens 3, a focal point of the plano-convex lens 3 is disposed on the second focal point F2 and the fourth focal point F4, so that the light source focusing on the second focal point F2 and the fourth focal point F4 is projected through the plano-convex lens, where an optical axis of the plano-convex lens 3 is located between the first optical axis 14 and the second optical axis 15.

Figure 6B:
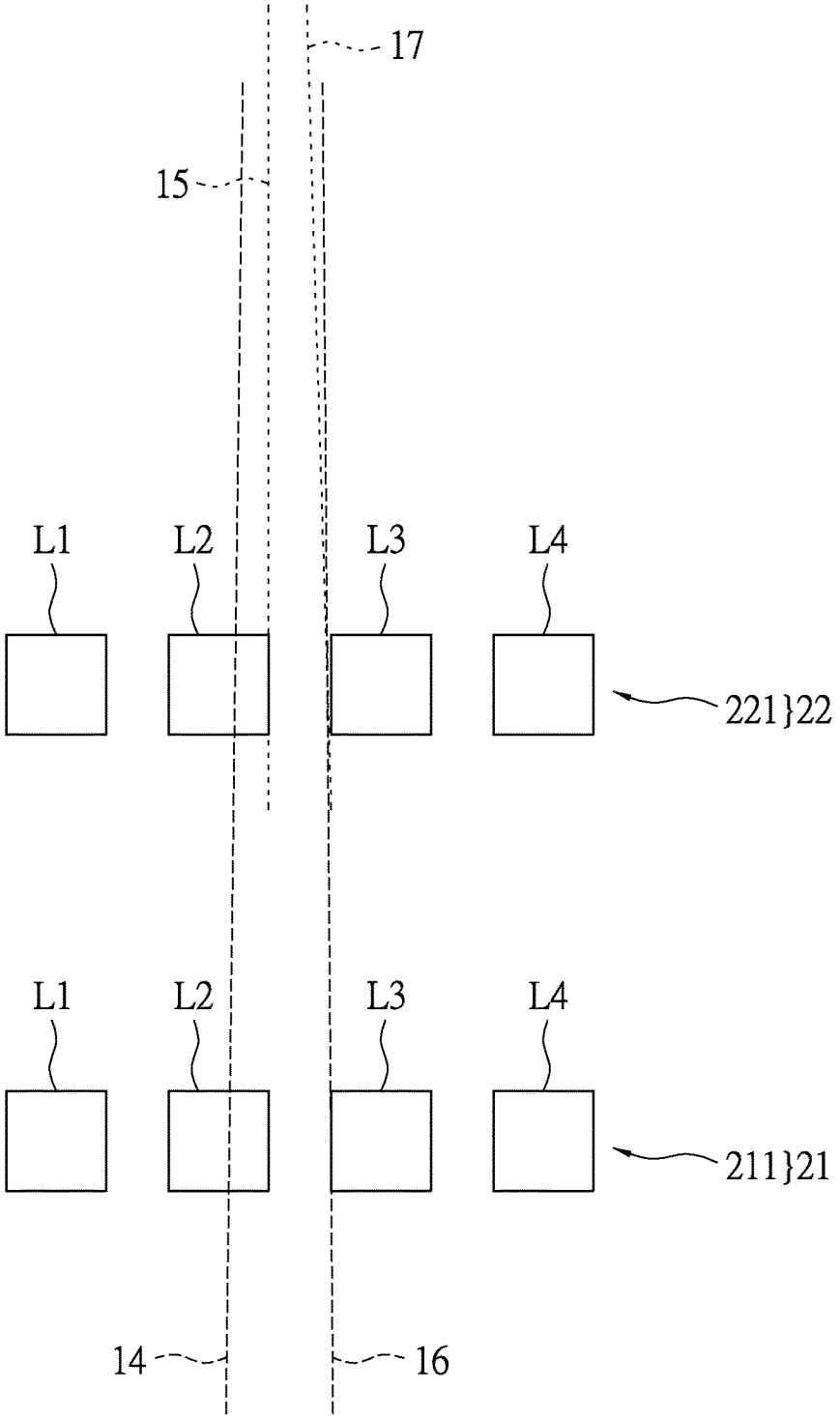
FIG. 6B is another schematic structural diagram of the vehicle lamp structure of the third embodiment of the present disclosure.

Referring to FIG. 6B, the light-emitting structure 2 is disposed in the lamp cup structure 1 in this embodiment. The light-emitting structure 2 includes the first light-emitting module 21 and the second light-emitting module 22. The first light-emitting module 21 includes multiple first light-emitting elements 211 for generating the first light source. The second light-emitting module 22 includes multiple second light-emitting elements 221 for generating the second light source. Each of the first light-emitting elements 211 and the second light-emitting elements 221 consists of four light-emitting diodes L1, L2, L3, and L4 each having a size of 1 mm×1 mm. The first light-emitting elements 211 and the second light-emitting elements 221 are discrete light sources. The distance between adjacent the light-emitting diodes among L1, L2, L3, and L4 is between 0.2 mm and 5 mm.

Also referring to FIG. 2A, the lamp cup structure 1 in the third embodiment may be similar to the lamp cup structure 1 in the first embodiment or the second embodiment. For the third embodiment, the first light-reflecting surface 11 has a first light-focusing curved surface 113 and a second light-focusing curved surface 114, the second light-reflecting surface 12 has a third light-focusing curved surface 123 and a fourth light-focusing curved surface 124, the first light-focusing curved surface 113 has a first optical axis 14, the second light-focusing curved surface 114 has a second optical axis 15, the third light-focusing curved surface 123 has a third optical axis 16, and the fourth light-focusing curved surface 124 has a fourth optical axis 17. The first optical axis 14 passes through the light-emitting diodes L2 of the first light-emitting module 21 and the second light-emitting module 22. The third optical axis 16 may pass along left side or right side edges of the light-emitting diodes L3 of the first light-emitting module 21 and the second light-emitting module 22. The second optical axis 15 and the fourth optical axis 17 may pass along left side or right side edges of the light-emitting diodes L2 and L3. However, the present disclosure is not limited thereto. In the present disclosure, the curvature of a focusing curved surface may be changed so that an optical axis passes through a light-emitting diode or along a left side or right side edge of the light-emitting diode. Further, in the present disclosure, if it is desired to increase the luminous intensity of the vehicle lamp structure V, more light-emitting modules may be disposed so that the projecting light source has higher illuminance or lumens and the projection distance of the light source can be increased.

Moreover, a control module may be used to control the turnon or turnoff of the first light-emitting module 21 and the second light-emitting module 22 and thus control the light distribution pattern, color temperature or colored light of the light source emitted by the light-emitting structure 2. Therefore, if light-emitting diodes with different colored light are used in combination, a light source with a different color can be obtained. Taking a white light as an example, a warm white light of 3000 K may be mixed with a blue light of about 460 nm, and a white light with another color temperature can be obtained. Alternatively, a warm white light of 3000 K may also be mixed with a cold white light of 6500 K to obtain a colored light of about 4000 K.

Because the curvatures of the light-focusing curved surfaces of the first light-reflecting surface 11 and the second light-reflecting surface 12 in the lamp cup structure 1 may be set in advance and the light-emitting structure 2 is correspondingly disposed at the focal points of the light-focusing curved surfaces, the lamp cup structure 1 provided by the third embodiment of the present disclosure is especially applicable to a discontinuous light-emitting diode package structure.

Possible Effects of the Embodiments

In sum, the beneficial effects of the present disclosure are in that, the vehicle lamp structure V provided by the present disclosure can be especially applicable to a discontinuous light-emitting diode package structure, and the light-emitting elements may be correspondingly disposed at the focal points of the light-reflecting surfaces in vehicle lamp structure 1, so that relevant regulations such as ECE R112 in the Regulations of United Nations Economic Commission for Europe (called ECE regulations for short) are met, the manufacturing cost is reduced, and the illuminance, the lumens, and the projection distance of the light source are increased.

The above description is only intended to provide the preferred embodiments of the present disclosure, and is not to limit the patent scope of the present disclosure. All equivalent technical variations made according to the specification and drawings of the present disclosure fall within the protection scope of the present disclosure

What is claimed is:

1. A vehicle lamp structure, comprising:

a lamp cup structure having a first light-reflecting surface and a second light-reflecting surface, wherein the first light-reflecting surface has a first focal point and a second focal point, the second light-reflecting surface has a third focal point and a fourth focal point, and the second focal point and the fourth focal point converge with each other; and a light-emitting structure including a first light-emitting module and a second light-emitting module, wherein the first light-emitting module includes at least one first light-emitting element for generating a first light source, and the second light-emitting module includes at least one second light-emitting element for generating a second light source, wherein the first light-reflecting surface and the second light-reflecting surface are separated from each other at a predetermined distance, the at least one of the first light-emitting element corresponds to the first focal point, and the at least one of the second light-emitting element corresponds to the third focal point;

the first light source generated by the at least one first light-emitting element is projected onto the first light-reflecting surface to form a first reflection light source through the second focal point, and the second light source generated by the at least one second light-emitting element is projected onto the second light-reflecting surface to form a second reflection light source through the fourth focal point;

the first light-reflecting surface is constituted of a first horizontal base line and a first vertical base line, and the second light-reflecting surface is constituted of a second horizontal base line and a second vertical base line; and the first horizontal base line and the first vertical base line have the common first focal point, and the second horizontal base line and the second vertical base line have the common third focal point.

2. The vehicle lamp structure according to claim 1, wherein the lamp cup structure has a light-diffusing surface disposed or connected between the first light-reflecting surface and the second light-reflecting surface.

3. The vehicle lamp structure according to claim 1, wherein the at least one of the first light-emitting element is adjacent to the first focal point and the at least one of the second light-emitting element is adjacent to the third focal point.

4. The vehicle lamp structure according to claim 1, wherein the at least one of the first light-emitting element is directly disposed at the first focal point and the at least one of the second light-emitting element is directly disposed at the third focal point.

5. The vehicle lamp structure according to claim 1, wherein the first light-reflecting surface has multiple light-focusing curved surfaces, each of the light-focusing curved surfaces of the first light-reflecting surface has a curved surface focal point, and the first light-emitting elements are disposed at the multiple curved surface focal points respectively; and the second light-reflecting surface has multiple light-focusing curved surfaces, each of the light-focusing curved surfaces has a curved surface focal point, and the second light-emitting elements are disposed at the multiple curved surface focal points respectively.

6. The vehicle lamp structure according to claim 1, wherein the distance between the first light-emitting module and the second light-emitting module is between 0.2 mm and 5 mm.

7. The vehicle lamp structure according to claim 1, wherein the first light-reflecting surface has a first light-focusing curved surface and a second light-focusing curved surface, the second light-reflecting surface have a third light-focusing curved surface and a fourth light-focusing curved surface, the first light-focusing curved surface has a first optical axis, the second light-focusing curved surface has a second optical axis, the third light-focusing curved surface has a third optical axis, and the fourth light-focusing curved surface has a fourth optical axis.

8. The vehicle lamp structure according to claim 7, wherein the first optical axis passes through the first light-emitting module, the third optical axis passes through the second light-emitting module, the second optical axis and the fourth optical axis are pass through between the first light-emitting module and the second light-emitting module.

9. The vehicle lamp structure according to claim 1, further comprising a plano-convex lens, wherein the lamp cup structure further comprising a first optical axis, and a second optical axis, the first optical axis passes through the first focal point and the second focal point, the second optical axis passes through the third focal point and the fourth focal point, a focal point of the plano-convex lens disposed at the second focal point and the fourth focal point.

10. The vehicle lamp structure according to claim 1, wherein the first vertical base line and the second vertical base line are disposed between the first horizontal base line and the second horizontal base line.

11. A lamp cup structure, comprising:

a first light-reflecting surface having a first focal point and a second focal point, the first focal point and the second focal point being located on a first optical axis; and a second light-reflecting surface having a third focal point and a fourth focal point, the third focal point and the fourth focal point being located on a second optical axis, wherein the first light-reflecting surface and the second light-reflecting surface are separated from each other at a predetermined distance, the second focal point and the fourth focal point converge with each other, and the first optical axis and the second optical axis intersect with each other on a position where the second focal point and the fourth focal point converge with each other;

the first light-reflecting surface is constituted of a first horizontal base line and a first vertical base line, and the second light-reflecting surface is constituted of a second horizontal base line and a second vertical base line; and the first horizontal base line and the first vertical base line have the common first focal point, and the second horizontal base line and the second vertical base line have the common third focal point.

12. The lamp cup structure according to claim 11, wherein the lamp cup structure has a light-diffusing surface disposed or connected between the first light-reflecting surface and the second light-reflecting surface.

13. The lamp cup structure according to claim 11, wherein at least one first light-emitting element is disposed adjacent to or directly on the first focal point and at least one second light-emitting element is disposed adjacent to or directly on the third focal point.

14. The vehicle lamp structure according to claim 13, wherein the distance between the at least one first light-emitting element and the at least one second light-emitting element is between 0.2 mm and 5 mm.

15. The lamp cup structure according to claim 11, wherein the first light-reflecting surface has multiple light-focusing curved surfaces, each of the light-focusing curved surfaces of the first reflector surface has a curved surface focal point, and multiple first light-emitting elements are disposed at the multiple curved surface focal points respectively; and the second light-reflecting surface has multiple light-focusing curved surfaces, each of the light-focusing curved surfaces has a curved surface focal point, and multiple second light-emitting elements are disposed on the multiple curved surface focal points respectively.

16. A vehicle lamp structure, comprising:

a lamp cup structure, having a first light-focusing curved surface and a second light-focusing curved surface connected to the first light-focusing curved surface, wherein the first light-focusing curved surface has a first focal point and a second focal point, the second light-focusing curved surface has a third focal point and a fourth focal point, and the second focal point and the fourth focal point converge with each other;

a light-emitting structure including a first light-emitting module and a second light-emitting module, wherein the first light-emitting module includes at least one first light-emitting element for generating a first light source, the second light-emitting module includes at least one second light-emitting element for generating a second light source, the at least one of the first light-emitting element corresponds to the first focal point, and at least one of the second light-emitting element corresponds to the third focal point; and a reflecting mirror disposed between the first light-emitting module and the second light-emitting module and immediately adjacent to the second light-emitting module and the third focal point, wherein the first light source generated by the at least one first light-emitting element is projected onto the first light-focusing curved surface to form a first reflection light source through the second focal point, one part of the second light source generated by the at least one second light-emitting element is directly projected onto the second light-focusing curved surface to form a second reflection light source through the fourth focal point, and the other part of the second light source generated by the at least one second light-emitting element is successively reflected by the reflecting mirror and the second light-focusing curved surface to form a third reflection light source through the fourth focal point;

the first light-reflecting surface is constituted of a first horizontal base line and a first vertical base line, and the second light-reflecting surface is constituted of a second horizontal base line and a second vertical base line; and the first horizontal base line and the first vertical base line have the common first focal point, and the second horizontal base line and the second vertical base line have the common third focal point.

* * * * *